US009052692B2

(12) United States Patent
Capt

(10) Patent No.: US 9,052,692 B2
(45) Date of Patent: Jun. 9, 2015

(54) MECHANISM FOR ADVANCING A KARUSSEL CAGE OR TOURBILLON CAGE BY PERIODIC JUMPS

(75) Inventor: Edmond Capt, Le Brassus (CH)

(73) Assignee: Blancpain S.A., Le Brassus (CH)

( * ) Notice: Subject to any disclaimer, the term of this patent is extended or adjusted under 35 U.S.C. 154(b) by 112 days.

(21) Appl. No.: 13/702,171

(22) PCT Filed: Jun. 16, 2011

(86) PCT No.: PCT/EP2011/060038
§ 371 (c)(1),
(2), (4) Date: Mar. 15, 2013

(87) PCT Pub. No.: WO2011/157797
PCT Pub. Date: Dec. 22, 2011

(65) Prior Publication Data

US 2013/0194900 A1 Aug. 1, 2013

(30) Foreign Application Priority Data

Jun. 17, 2010 (EP) ..... 10166350

(51) Int. Cl.
*G04B 15/00* (2006.01)
*G04C 5/00* (2006.01)
(Continued)

(52) U.S. Cl.
CPC ..... *G04B 15/06* (2013.01); *G04B 17/28* (2013.01); *G04B 17/285* (2013.01)

(58) Field of Classification Search
CPC ..... G04B 17/00; G04B 17/285; G04B 15/00; G04B 15/10
USPC ..... 368/124, 127–132
See application file for complete search history.

(56) References Cited

U.S. PATENT DOCUMENTS 7,316,504 B1 * 1/2008 Mock et al. ..... 368/127
2003/0112709 A1 * 6/2003 Mojon ..... 368/127
(Continued)

FOREIGN PATENT DOCUMENTS

EP 1 319 997 6/2003
EP 1 528 443 5/2005
(Continued)

OTHER PUBLICATIONS

International Search Report Issued Sep. 29, 2011 in PCT/EP11/060038 Filed Jun. 16, 2011.

*Primary Examiner* — Amy Cohen Johnson
*Assistant Examiner* — Daniel Wicklund
(74) *Attorney, Agent, or Firm* — Oblon, McClelland, Maier & Neustadt, L.L.P.

(57) ABSTRACT

A mechanism for advancing, by periodic jumps, a pivoting cage for an escapement mechanism, including: a retaining mechanism authorizing or preventing the pivoting of the cage, depending on its movement; and a stopping mechanism authorizing or preventing the pivoting of the retaining mechanism, depending on its angular position. A constant force device causes periodic cooperation of the retaining mechanism, which includes a flirt arranged to perform complete revolutions and is connected to an input thereof, with the stopping mechanism, which includes a star wheel and is connected to an output thereof, whose trajectories interfere with each other, to pivot the cage when the stopping mechanism allows the pivoting of the retaining mechanism and to stop the cage when the stopping mechanism locks the retaining mechanism.

18 Claims, 1 Drawing Sheet

(51) Int. Cl.
*G04B 15/06* (2006.01)
*G04B 17/28* (2006.01)

(56) References Cited

U.S. PATENT DOCUMENTS

2005/0088918 A1 4/2005 Journe
2007/0127319 A1* 6/2007 Goeller ..... 368/124
2007/0147179 A1* 6/2007 Girardin et al. ..... 368/147
2008/0198701 A1* 8/2008 Lete et al. ..... 368/127
2011/0019506 A1* 1/2011 Dehon ..... 368/127
2011/0026373 A1* 2/2011 Kasapi et al. ..... 368/127
2012/0250468 A1* 10/2012 Bas et al. ..... 368/129
2013/0155820 A1* 6/2013 Rochat ..... 368/128

FOREIGN PATENT DOCUMENTS

EP 1 744 229 1/2007
EP 1 772 783 4/2007

* cited by examiner

MECHANISM FOR ADVANCING A KARUSSEL CAGE OR TOURBILLON CAGE BY PERIODIC JUMPS

CROSS-REFERENCE TO RELATED APPLICATIONS

This is a National Phase application in the United States of International Patent Application PCT/EP2011/060038 filed Jun. 16, 2011, which claims priority on European Patent Application No. 10166350.8 of Jun. 17, 2010. The entire disclosures of the above patent applications are hereby incorporated by reference.

FIELD OF THE INVENTION

The invention concerns a mechanism for advancing a pivoting cage, by periodic jumps, said cage carrying an escape wheel and an escape pinion in addition to a pallet lever cooperating with said escape wheel and with a sprung balance, said mechanism comprising:

- a pivoting retaining means arranged to cooperate with said cage to authorise or to prevent the pivoting of said cage, depending on whether said retaining means is pivoting or stopped;
- a pivoting stopping means arranged to cooperate with said retaining means to authorise or prevent the pivoting of said retaining means, according to the angular pivoting position of said pivoting stopping means.

The invention more particularly concerns a mechanism for advancing, in jumps, the cage of an independent seconds tourbillon or karussel.

The invention also concerns a tourbillon including a tourbillon cage and mechanism of this type.

The invention also concerns a karussel including a karussel cage and mechanism of this type.

The invention also concerns a timepiece including this type of mechanism or karussel or tourbillon.

The invention concerns the field of horology.

It more particularly concerns the field of watches with complications.

BACKGROUND OF THE INVENTION

The jumping display, known as an independent seconds or independent minutes display, or any other time interval, is always a complex complication to make, since known embodiments cause a relatively abrupt jump, which results in shocks inside the mechanism, which are transmitted as far as the escapement, which is not ideal for the proper working and longevity of the watch.

These known embodiments generally combine a mechanism using cooperation between a star wheel and a flirt on the one hand, and a constant force device on the other hand, to moderate the effects of any shock on the movement.

Thus Swiss Patent No. CH 47 297 in the name of Pellaton-Schild disclosed, in 1907, an independent jumping seconds mechanism, with two contrate gears connected to each other by a spiral spring, one of which drives the escape pinion, which is coaxial and secured to a star wheel comprising projecting teeth. Via a gear train, the going barrel drives a pinion carrying a flirt, which rests each time on one tooth of the star wheel, and the relative pivoting thereof causes a position in which the flirt escapes from the tooth, in a jump, and completes one revolution before returning to abut on another tooth of the star wheel.

There is known a European Patent Application No. 1 319 997 in the name of Richemont International SA which discloses a tourbillon mechanism incorporating a constant force device.

This tourbillon mechanism includes a pivoting cage driven by a drive wheel. The tourbillon cage is coaxial to a pivoting balance provided with a balance spring and with a fixed fourth wheel and carries, at three distinct off-centre positions, an off-centre escape wheel, a first pallet lever and a stop wheel which meshes with said fixed fourth wheel. The escape wheel cooperates with said first pallet lever provided with two pallet stones. Coaxial to the escape wheel, a constant force device includes an escape spring, secured at a first end to the escape wheel, and at a second end to a force compensating disc. The disc rotates integrally with a ring for winding the escape spring and with a winding ring pinion associated therewith which cooperates with the fixed fourth wheel.

Coaxially secured to the escape wheel, a substantially triangular Reuleux cam cooperates with a fork comprised in a second pallet lever coaxial to the balance, which pivots about the axis of the tourbillon cage. This second pallet lever comprises a cam arranged to cooperate with a fork and a dart carried by the first pallet lever. The second pallet lever includes two pallet stones arranged to cooperate with radially projecting teeth comprised in the stop wheel.

The balance is driven under the effect of the prestress of the escape wheel and is returned by the balance spring. Depending on the number of teeth of the escape wheel, the balance makes a certain number of vibrations, for example five with a wheel having fifteen teeth, before the stop wheel and tourbillon cage are released by the Reuleux cam and the second pallet lever is centred on the balance. Depending upon the number of teeth it has, the stop wheel achieves a given angular travel, for example 90°, before being stopped again by one of the pallet stones of the second pallet lever centred on the balance. Since the stop wheel and the stop pinion are carried by the tourbillon cage and since the stop pinion meshes with the fixed fourth wheel, the pivoting of the stop wheel causes the tourbillon cage to pivot. Consequently, this pivoting also causes the winding ring, which is fixed to the cage and also meshes with the fourth wheel, to pivot, tensioning the escape spring again, since the escape wheel is then locked by the first pallet lever. The escape spring is periodically tensioned again by the repetition of this cycle. The spring thus accumulates enough energy to deliver sufficient torque to maintain the oscillations of the balance.

The object of this compensation mechanism is to deliver a constant torque.

The first end of the escape spring is secured to a first pin integral with a first escape spring collet connected to the escape wheel. The second end of the escape spring is fixed to a second pin secured to a second mobile escape spring collet.

The escape spring, once taut, exerts a force on the first pin, and therefore exerts a torque on a first arm of the force compensating disc comprised in said constant force device. The latter includes first and second arms, arranged to abut respectively on the first and second pin, and the bearing surfaces of these arms are aligned with each other but in an off-centre direction relative to the axis of the escape wheel. The second arm abuts on the second pin and transmits the torque to the fixed spring collet and to the escape wheel. Due to the off-centre arrangement of the direction of the two arms, the lever arm of the stresses exerted by and on the pins varies according to the angular position of the force compensating disc, despite the lost tension of the escape spring while the gear train assembly is stopped from the spring to the stop wheel.

During each vibration of the balance, the escape wheel is released from the first pallet lever and pivots through a certain angle, under the action of the escape spring, just like the first spring collet and the force compensating disc, whereas the winding ring and stop wheel are locked. On each fifth vibration, the stop wheel and the tourbillon cage are released.

This EP Patent No. 1 319 997 therefore discloses a perfectly functional system, which provides a seconds display in a tourbillon cage, but which remains very complex, and requires a compensating mechanism in addition to the constant force device. It has to comprise two springs, two pallet levers, a cam fork device and not only has a high production cost due to the number and complexity of the components, but is relatively fragile and difficult to adjust properly.

EP Patent Application No. 1 772 783 in the name of MONTRES BREGUET SA discloses a watch movement including a constant force device, and an independent minute display on the centre wheel, which is capable of driving a tourbillon in a satisfactory manner with the constant force device. It includes a third wheel set, which completes one revolution in several minutes, and which forms the input device of a constant force device. The output element of this balance spring device is formed by a second third wheel which meshes with the fourth pinion, which is integral with a tourbillon cage. This second third wheel is integral with a star wheel, which periodically, in this case once per minute, releases a stop train meshed with the input third wheel set, which cooperates with the centre wheel, which therefore jumps once per minute. This mechanism minimises the transmission of shocks between the constant force device and the escapement.

EP Patent Application No. 1 528 443 A1 in the name of JOURNE, which discloses an independent constant force device, is also known. An energy storage spring tends to pivot a lever. A pinion of a first fourth wheel of the movement meshes with an intermediate wheel pivotally mounted on said lever. This intermediate wheel meshes with the pinion of a second fourth wheel, the arbour of which is secured to a tourbillon escapement. The lever carries a finger, which is arranged to cooperate with a ratchet toothing of a stop wheel which meshes with the first fourth wheel. When the finger is in mesh with a radial flank of the ratchet, the gear train is stopped and there is no transmission of force between the first fourth wheel and the intermediate wheel. During this stopped period, which lasts for one second, the spring torque is released and causes the lever to rotate until the finger is released from the ratchet. The second fourth wheel is controlled by the escapement, and only rotates when the said escapement is moved by the balance. The spring is wound by the movement of the lever in the opposite direction, said spring exerting a lower torque on the balance than that exerted by the barrel spring on the lever when the stop wheel is released. This device allows the winding/letting down cycle to be adapted by choosing the number of teeth in the stop wheel. The working of the device requires the presence of the energy storage spring.

In each case, the constant force device provides an advantage, which is to ensure a relatively constant drive torque for the escapement, but which necessarily involves a significant space requirement and high costs.

SUMMARY OF THE INVENTION

The invention proposes to provide a more economical alternative karussel or tourbillon with independent seconds, which uses the simplicity of star wheel and flirt devices, but reduces shocks and requires the fewest possible additional components within the smallest possible volume.

The invention concerns a mechanism for advancing a pivoting cage, by periodic jumps, said cage carrying an escape wheel and an escape pinion in addition to a pallet lever cooperating with said escape wheel and with a sprung balance, said mechanism comprising:

a pivoting retaining means arranged to cooperate with said cage to authorise or to prevent the pivoting of said cage, depending on whether said retaining means is pivoting or stopped;

a pivoting stopping means arranged to cooperate with said retaining means to authorise or prevent the pivoting of said retaining means, according to the angular pivoting position of said pivoting stopping means; and characterized in that:

said retaining means and said stopping means are carried by said cage;

said mechanism includes a constant force device which causes the periodic and direct cooperation between, on the one hand, said retaining means connected by a direct mechanical connection to the input thereof, and, on the other hand, said stopping means connected by a direct mechanical connection to the output thereof, said retaining means having a trajectory which interferes with that of said stopping means, in order to pivot said cage when said stopping means allows the pivoting of said retaining means, and to stop said cage when said stopping means locks said retaining means.

According to a feature of the invention, said retaining means includes a flirt at the input of said constant force device, said flirt being arranged to perform complete revolutions, and said stopping means includes a star wheel at the output of said constant force device, the trajectory of said star wheel interfering with that of said flirt, in order to pivot said cage when said star wheel releases said flirt and otherwise stopping said cage.

According to a feature of the invention, said retaining means and said stopping means are arranged to cause said cage to make one jump per second.

The invention more particularly concerns a mechanism for advancing, in jumps, the cage of an independent seconds tourbillon or karussel.

The mechanism according to the invention offers the advantage of great compactness and a reduced number of components. The entire system is integrated in the cage, which frees space in the timepiece for other complications.

The invention also concerns a tourbillon including a tourbillon cage and mechanism of this type.

The invention also concerns a karussel including a karussel cage and mechanism of this type.

The invention also concerns a timepiece comprising this type of mechanism or a tourbillon or karussel of this type.

BRIEF DESCRIPTION OF THE DRAWINGS

Other features and advantages of the invention will appear in more detail upon reading the following description, with reference to the indexed drawings, in which.

DETAILED DESCRIPTION OF PREFERRED EMBODIMENTS

Figure 1:
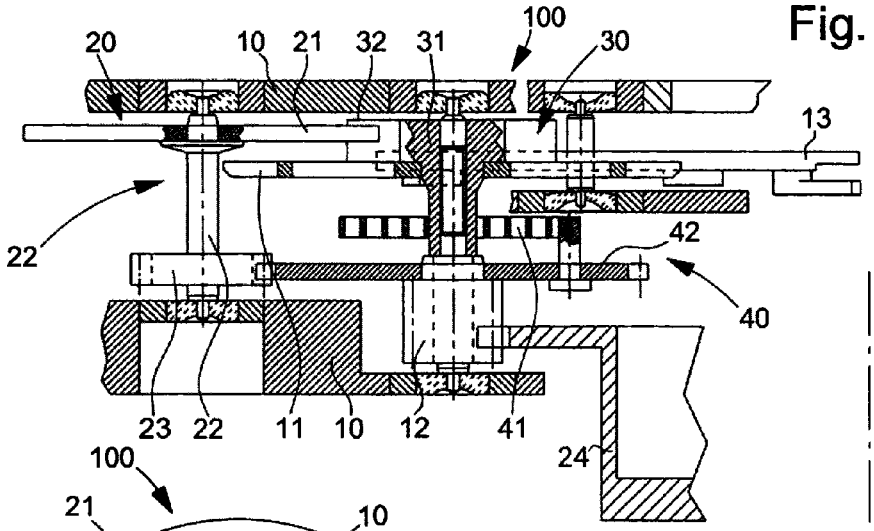
FIG. 1 shows a schematic, partial, cross-section of the jumping mechanism according to a preferred embodiment.
Figure 2:
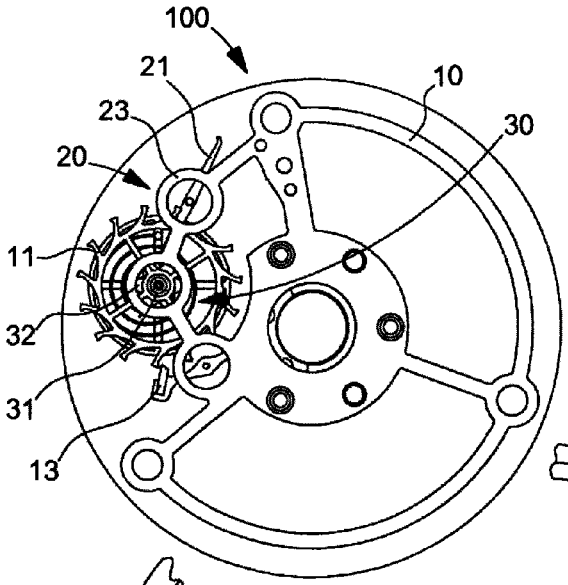
FIG. 2 shows a schematic, partial, top view of the mechanism of FIG. 1.

The invention concerns the field of horology.

It more particularly concerns the field of watches with complications, and more specifically that of the jumping display, known as independent seconds, or independent minutes or with any other time interval.

The mechanism according to the invention is a mechanism 100 for advancing, by period jumps, a means of displaying a time magnitude, particularly the seconds and then called an "independent seconds". The invention is described here for the preferred application where the display means is a cage 10 pivoting about a cage axis, either a tourbillon cage as described and illustrated here, or a karussel cage, comprised in mechanism 100, or in a timepiece in which mechanism 100 is incorporated.

The karussel or tourbillon cage is parallel to the axis of a sprung balance, and can notably, in a particular version, be coaxial to said balance.

Cage 10 comprises, preferably arranged off-centre, an escape wheel 11 and an escape pinion 12, and a pallet lever 13 which cooperates with said wheel 11 and said balance.

In a particular variant, escape wheel 11 and escape pinion 12 are coaxial.

In a particular variant, the escape wheel 11 and the escape pinion 12 are off-centre relative to the cage 10.

Mechanism 100 includes:

- a moveable retaining means 20, which preferably pivots, arranged to cooperate with cage 10 to allow or prevent the pivoting movement of said cage, according to whether said retaining means is moving, preferably by pivoting, or is stopped;
- a moveable stopping means 30, preferably a pivoting means, arranged to cooperate with retaining means 20 in order, depending on the position of stopping means 30, particularly and preferably according to the angular pivoting position of pivoting stopping means 30, to allow or prevent the movement of retaining means 20, particularly and preferably the pivoting movement of retaining means 20.

According to the invention, the retaining means 20 and the stopping means 30 are carried by cage 10.

Also according to the invention, mechanism 100 includes a constant force device 40 which causes the periodic and direction cooperation between, on the one hand, retaining means 20 connected by a direct mechanical connection to the input of said device, and on the other hand, stopping means 30 connected by direct mechanical connection to the output of said device, said retaining means 20 having a trajectory that interferes with that of stopping means 30, in order to pivot cage 10 when stopping means 30 allow the movement, particularly the pivoting movement, of retaining means 20 and for stopping cage 10 when stopping means 30 locks retaining means 20.

Retaining means 20 is connected by a direct mechanical connection to the input of constant force device 40. In the embodiment described here this direct mechanical connection is a gearing, but it could equally well be achieved by another direct mechanical transmission, without departing from the invention. A "direct mechanical connection" means here both a continuous connection and a synchronous connection.

Stopping means 30 is connected by a direct mechanical connection to the output of constant force device 40. In the preferred example described here, it is secured to an escape wheel 11 which forms said output. Thus, in this specific case, stopping means 30 is directly connected to said output.

Preferably, this constant force device 40 is of the spiral spring type and will be explained below.

Thus, the invention no longer requires the intermediate mechanisms of the prior art, which, particularly in the form of a pallet lever, were inserted between the retaining means connected to one end of the constant force device such as a cam, on the one hand, and the stopping means connected to the other end of the constant force device such as stopping wheel on the other hand. The removal of this intermediary is a great advantage of the invention, since it simplifies the mechanism enormously, makes it less expensive and means that the difficult adjustment of a pallet lever mechanism is no longer necessary. Moreover, the omission of the pallet lever means that the retaining means 20 and stopping means 30 can be moved closer into direct contact, thereby saving volume in the cage. The "cage volume" means here the volume of the smallest cylinder circumscribed to said cage 10 and aligned with the same pivot axis as cage 10. Mechanism 100 according to the invention is extremely compact and, with the escapement, occupies less than a third, and particularly less than a quarter of the volume of cage 10, which leaves space for other complications.

In one embodiment of the invention in the form of independent seconds, retaining means 20 and stopping means 30 are arranged to cause said cage to make one jump per second. The mechanism according to the invention, which is described here for the jumping display of independent seconds, is applicable to the display of another independent magnitude (the minutes or other magnitude), the various pinions and wheels being calculated accordingly.

Preferably, retaining means 20 includes a flirt 21 and stopping means 30 includes a star wheel 31. The trajectory of star wheel 31 interferes with that of flirt 21, in order to pivot cage 10 when star wheel 31 releases flirt 21 and otherwise to lock said cage, i.e. when star wheel 31 locks flirt 21.

In the embodiment illustrated here, retaining means 20 includes a retaining wheel set 22, which comprises flirt 21, secured to the input of constant force device 40.

Preferably, stopping means 30 includes a retaining star wheel 31, integral with a the output of constant force device 40, each tooth 32 of which is arranged to cooperate with flirt 21 and periodically to stop and release said flirt 21 according to the angular position of retaining star wheel 31.

Figure 3:
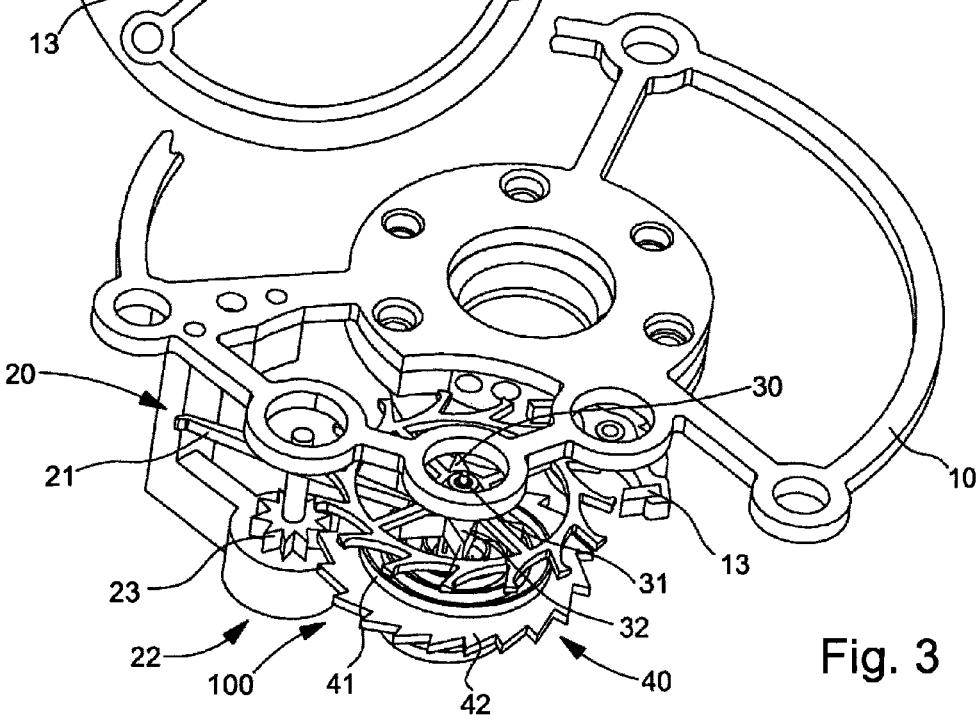
FIG. 3 shows a schematic partial perspective view of the mechanism of FIG. 1.

Pivoting retaining means 20 is formed, in the example of the Figures, by a retaining wheel set 22 comprising a flirt pinion 23 and at least one flirt 21, arranged to cooperate with retaining star wheel 31. In certain positions, such as that shown in FIG. 1, flirt 21 is held under tension, in abutment on a blade 32 of retaining star wheel 31, until said star wheel reaches an angular position that allows the release of flirt 21, or of a flirt arm if flirt 21 comprises multiple arms, a double arm as seen in FIGS. 1 and 3, or is star-shaped for example. Flirt 21 is pivotally moveable about the axis of flirt wheel set 22, and is an element arranged to perform complete revolutions. Selecting a solution with a constant pivoting direction ensures great longevity for the mechanism, and that any play will always be reduced in the same direction. The embodiment is particularly simple and economical.

In the example of FIG. 1, when flirt 21 is released by tooth 32 of star wheel 31, which was holding it stopped, i.e. each second in this particular case, it allows the pivoting movement of flirt wheel set 22, here through a half-revolution, until flirt 21 abuts again on another blade of retaining star wheel 31. If flirt 21 has a single arm, flirt wheel set 22 makes one complete revolution. If flirt 21 has multiple arms, the pivoting amplitude is reduced accordingly, for example a half revolution if flirt 21 comprises two opposite arms.

More specifically, mechanism 100 for advancing, by periodic jumps, a karussel cage 10 or tourbillon cage of a timepiece, comprises a motion transmitting gear train driven by energy storage means and pivotally moveable relative to a plate. This transmitting gear train is not shown in the Figures. It may take the conventional form of a fourth pinion axially driving cage 10, or any other similar configuration.

Cage 10 pivots about a cage axis. It has a point for fastening a first end of a balance spring, the other end of which is fastened to a balance pivotally moveable about a balance axis parallel or merged with said cage axis. Preferably, cage 19 is coaxially mounted to the sprung balance which is formed of the balance and the balance spring.

Cage 10 includes:

on the one hand, an escape mechanism comprising an escape wheel 11 pivoting about an escape arbour parallel to said cage axis and to the arbour of an escape pinion 12 to which it is connected by constant force device 40;

on the other hand a pallet lever 13 pivoting about a pallet lever arbour parallel to the cage axis and arranged to cooperate, on the one hand with escape wheel 11 and on the other hand with the balance.

In a particular preferred embodiment, cage 10 carries this escape mechanism 40 in an off-centre arrangement.

In a particular preferred variant, cage 10 carries said pivoting pallet lever in an off-centre arrangement.

Escape pinion 12 meshes directly or indirectly with a fourth wheel 24. In the example of FIG. 1, this fourth wheel 24 is fixed. The axis of fourth wheel 24 preferably merges with the pivot pin of cage 10 which carries the pivot pin of escape pinion 12.

Preferably according to the invention, this escape pinion 12 forms the only point of contact of mechanism 100 with this fixed fourth wheel 24 coaxial to cage 10, comprised in the movement or timepiece, which incorporates mechanism 100.

Cage 10 permanently tends to pivot under the action of the motion transmitting gear train. Constant force device 40 causes the periodic cooperation of retaining means 20 with stopping means 30, so that cage 10 pivots about the cage axis by the rotation of escape pinion 12 about the fourth wheel 24 when stopping means 30 allows the pivoting of retaining means 20. Conversely, the constant force device holds cage 10 stopped when stopping means 30 locks retaining means 20.

Thus, in the preferred embodiment illustrated in the Figures, constant force device 40 causes the periodic cooperation of flirt 21 with star wheel 31, so that cage 10 pivots about the cage axis when star wheel 31 releases flirt 21, and so that cage 10 is held stopped when star wheel 31 locks flirt 21.

According to a feature of the invention, the constant force device 40 includes a spiral spring 41 whose first end is connected to escape wheel 11 which carries stopping means 30 and particularly star wheel 31, and whose second end is connected to a second escape wheel 42. This second escape wheel 42 meshes with flirt pinion 23 secured to retaining means 20 and particularly to flirt 21. Escapement pinion 12 is preferably secured to and coaxial with the second escape wheel 42.

Preferably, the second escape wheel 42 is coaxial with the calibre escape wheel 11.

In particular, the jump forward is thus achieved in this cage 10. The principle of the invention is to subject the pivoting movement of the cage to a certain period, which is not necessarily determined by the oscillator frequency as is usually the case, but which is chosen at a particular rhythm, for example in the embodiment described below where the cage changes from second to second while marking the second.

When an obstacle prevents cage 10 from pivoting, only the pivoting movement of escape pinion 12 occurs about the axis thereof, and regulation of the oscillator is therefore never interrupted. If the obstacle is removed and cage 10 is free to pivot, then cage 10 pivots and escape wheel 12 also pivots about its axis in the same way as in the preceding case.

When star wheel 31 locks flirt 21, cage 10 cannot rotate and the drive force only reaches escape pinion 12. In constant force device 40, pallet lever 13 allows the spiral spring 41 to be wound. The system is a constant force system since spiral spring 41 is always wound to the same value.

When star wheel 31 releases flirt 21 and thus escape pinion 12, cage 10 can rotate and thus makes a jump, since the release of flirt 21 is instantaneous.

Mechanism 100 according to the invention is extremely compact and, with the escapement, occupies an angular sector of less than a quarter of the volume of cage 10, which leaves space for other complications.

Preferably, the radial derived from the pivot pin of cage 10 carrying the pivot pin of pallet lever 13 is substantially symmetrical to the radial derived from the pivot pin of cage 10 carrying the pivot pin of flirt 21, relative to the radial derived from the pivot pin of cage 10 carrying the pivot pin of escape pinion 12 and star wheel 31.

In short, in the preferred embodiment shown in the Figures, flirt 21 is connected to the input of constant force device 40, by escape pinion 12, second escape wheel 42 and flirt pinion 23. Star wheel 31 is connected to the output of the constant force device 40, by calibre escape wheel 11. Flirt 21 and star wheel 31 cooperate directly with each other, with no intermediary.

The invention more particularly concerns a mechanism 100 for advancing, in jumps, the cage of an independent seconds tourbillon or karussel.

The invention also concerns a tourbillon comprising a tourbillon cage 10 and a mechanism 100 of this type.

The invention also concerns a karussel comprising a karussel cage 10 and a mechanism 100 of this type.

The invention also concerns a timepiece comprising this type of mechanism 100 or a tourbillon or karussel of this type.

The mechanism according to the invention offers the advantage of great compactness and a reduced number of components. The entire system is integrated in the cage, which frees space in the timepiece for other complications.

The invention claimed is:

1. A mechanism for advancing, by periodic jumps, a pivoting cage, said cage carrying a first escape wheel and an escape pinion in addition to a pallet lever cooperating with said first escape wheel and with a sprung balance, said mechanism comprising:

a pivoting retaining means arranged to cooperate with said cage to authorize or to prevent pivoting of said cage, depending on whether said retaining means is pivoting or stopped;

a pivoting stopping means arranged to cooperate with said retaining means to authorize or prevent the pivoting of said retaining means, according to the angular pivoting position of said pivoting stopping means;

and wherein:

said retaining means and said stopping means are carried by said cage;

said mechanism includes a constant force device which causes periodic and direct cooperation between said retaining means connected by a direct mechanical connection to an input of said device, and said stopping means connected by a direct mechanical connection to an output thereof, a trajectory of said retaining means interfering with that of said stopping means to pivot said cage when said stopping means allows the pivoting of said retaining means, and to stop said cage when said stopping means locks said retaining means;

said retaining means includes a flirt at the input of said constant force device, said flirt being arranged to perform complete revolutions, and wherein said stopping means includes a star wheel at the output of said constant force device, a trajectory of said star wheel interfering with that of said flirt, to pivot said cage when said star wheel releases said flirt and otherwise to stop said cage, wherein said retaining means are formed by a wheel set pivoting about an axis of flirt wheel set and comprising, fixed on a same arbour about said axis of flirt wheel set, a flirt pinion and at least one flirt, said at least one flirt being arranged to directly cooperate with said star wheel, in certain positions in abutment on a blade of said star wheel, until said star wheel reaches an angular position that allows the release of said flirt, wherein said mechanism includes a motion transmitting gear train driven by an energy storage means and pivotally moveable relative to a plate, and wherein said cage can pivot about a cage axis, said cage carrying an escape mechanism comprising the first escape wheel pivoting about an escape axis parallel to said cage axis and to the axis of an escape pinion to which said first escape wheel is connected by said constant force device, said cage further carrying the pallet lever pivoting about a pallet lever axis parallel to said cage axis and arranged to cooperate with said first escape wheel and with said balance, and wherein said constant force device comprises a spiral spring, whose first end is connected to said first escape wheel which carries said stopping means and said star wheel which is coaxial with said first escape wheel, and whose second end is connected to a second escape wheel directly meshing with said flirt pinion secured to said flirt, said escape pinion being secured and coaxial to the second escape wheel.

2. The mechanism according to claim 1, wherein said retaining means and said stopping means are arranged to cause said cage to perform one jump per second.

3. The mechanism according to claim 1, wherein said cage is coaxial to said sprung balance.

4. The mechanism according to claim 1, wherein said first escape wheel and said escape pinion are coaxial.

5. The mechanism according to claim 1, wherein said first escape wheel and said escape pinion are off-centre relative to said cage.

6. The mechanism, according to claim 1, wherein said escape pinion meshes directly or indirectly with a fourth wheel and wherein said cage permanently tends to pivot, under action of said motion transmitting gear train, and wherein said constant force device causes the periodic cooperation between said retaining means and said stopping means, so that said cage pivots about said cage axis via the rotation of said escape pinion about said fourth wheel, when said stopping means allows the pivoting of said retaining means and so that said cage is held stopped when said stopping means locks said retaining means.

7. The mechanism according to claim 6, wherein said fourth wheel is coaxial with said cage.

8. The method according to claim 1, wherein said cage carries said escape mechanism in an off-center arrangement.

9. The mechanism according to claim 1, wherein said cage carries said pivoting pallet lever in an off-center arrangement.

10. The mechanism according to claim 1, wherein said first escape wheel is coaxial to said escape pinion.

11. The mechanism according to claim 1, wherein the axis of said balance and said cage axis are merged.

12. The mechanism according to claim 1, wherein said second escape wheel is coaxial with said escape wheel.

13. The mechanism according to claim 1, wherein said escape pinion forms the only point of contact of said mechanism with a fixed fourth wheel coaxial to said cage, comprised in movement or a timepiece which incorporates said mechanism.

14. The mechanism according to claim 1, wherein the radial derived from the pivot pin of said cage carrying the pivot pin of said pallet lever is substantially symmetrical to the radial derived from the pivot pin of said cage carrying the pivot pin of said flirt, relative to the radial derived from the pivot pin of said cage carrying the pivot pin of said escape pinion and of said star wheel, and wherein with the escape mechanism, said mechanism occupies less than a quarter of a volume of a smallest cylinder circumscribed to said cage and aligned with the same pivot axis as said cage.

15. The mechanism according to claim 1, wherein with the escape mechanism, said mechanism occupies less than a quarter of a volume of a smallest cylinder circumscribed to said cage and aligned with the same pivot axis as said cage.

16. A tourbillon including a tourbillon cage and a mechanism according to claim 1.

17. A karussel including a karussel cage and a mechanism according to claim 1.

18. A timepiece including a mechanism according to claim 1.

* * * * *